US006866023B2

(12) United States Patent
Hasegawa

(10) Patent No.: US 6,866,023 B2
(45) Date of Patent: Mar. 15, 2005

(54) LEAN BURN ENGINE CONTROL SYSTEM

(75) Inventor: Shumpei Hasegawa, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 3 days.

(21) Appl. No.: 10/608,222

(22) Filed: Jun. 30, 2003

(65) Prior Publication Data

US 2004/0079334 A1 Apr. 29, 2004

(30) Foreign Application Priority Data

Jul. 5, 2002 (JP) ..... 2002-197336

(51) Int. Cl.[7] ..... F02D 9/02

(52) U.S. Cl. ..... 123/406.45; 123/399; 123/443; 123/406.52

(58) Field of Search ..... 123/399, 406.44, 123/406.45, 406.52, 406.53, 443; 701/103, 113

(56) References Cited

U.S. PATENT DOCUMENTS 5,150,680 A * 9/1992 Nishimura ..... 123/399
5,307,777 A * 5/1994 Sasajima et al. ..... 123/399
5,381,771 A * 1/1995 Leshner ..... 123/436
5,448,974 A * 9/1995 Toda ..... 123/400
6,089,208 A * 7/2000 Kowatari et al. ..... 123/396
6,164,623 A * 12/2000 Ito et al. ..... 251/305
2004/0016419 A1 * 1/2004 Satou et al. ..... 123/492

FOREIGN PATENT DOCUMENTS

JP 36570 * 2/2004 ..... F02D/9/02

* cited by examiner

*Primary Examiner*—Hai Huynh
(74) *Attorney, Agent, or Firm*—Birch, Stewart, Kolasch & Birch, LLP

(57) ABSTRACT

A control system that enables optimum lean burn control only by operating one lever beyond a lean limit of a lean burn engine. A link mechanism opens a throttle valve at an angle according to the manipulated variable of a power lever while the throttle valve is located in a range from an idle position to a full throttle position. When the power lever is further operated beyond the full throttle position of the throttle valve, the throttle valve is kept at a full throttle state independent of the position of the power lever and only a positional sensor outputs a signal according to the manipulated variable of the power lever. The degree of leaning of an air-fuel mixture is determined according to the manipulated variable of the power lever.

20 Claims, 10 Drawing Sheets

LEAN BURN ENGINE CONTROL SYSTEM

BACKGROUND OF THE INVENTION

CROSS-REFERENCE TO RELATED APPLICATIONS

The present nonprovisional application claims priority under 35 USC 119 to Japanese Patent Application No. 2002-197336 filed on Jul. 5, 2002 the entire contents thereof is hereby incorporated by reference.

1. Field of the Invention

The present invention relates to a control system of a lean burn engine. More particularly, to a control system of a lean burn engine suitable for lean burn control.

2. Description of Background Art

A lean burn control is known wherein the air-fuel ratio of an air-fuel mixture is controlled so that the air-fuel ratio becomes leaner than the stoichiometric air-fuel ratio in the steady driving mode and the slow acceleration mode of an engine. In a reciprocating engine for an aircraft, when an air-fuel ratio is shifted to the lean side by operating a mixture control lever provided separately from a power lever, the ratio of fuel economy is enhanced up to a predetermined value. However, as the engine begins to stall when an air-fuel mixture becomes lean, the ratio of fuel economy is deteriorated. The air-fuel ratio at this time is called a lean limit and the value is greatly different depending upon whether the engine is a lean burn engine or not.

FIG. 13 shows an example of a relation in an air-fuel ratio (and a throttle angle) and specific fuel consumption between a lean burn engine and a normal engine except in the normal engine a lean limit exists in the vicinity of 17. However, in the lean burn engine, even if a throttle angle reaches a full throttle position, there is no lean limit.

In the normal engine, the lean limit is set in the vicinity of an intermediate angle of a throttle valve and when the throttle valve is further opened and intake air quantity is increased, the output characteristic of an engine is secured by returning a mixture control lever, increasing injection quantity and decreasing the degree of leaning.

In the meantime, in the lean burn engine, the lean limit exists on the leaner side, compared with that in the normal engine and the lean burn engine is provided with a characteristic that even if a throttle valve is turned a full throttle state and the quantity of air is maximum, low fuel consumption is still maintained.

Such a control system of the reciprocating engine for an aircraft is disclosed, for example, in Japanese published unexamined patent application No. Hei6-247392.

In the prior art described above, in case injection quantity is increased beyond the lean limit in the normal engine, a pilot is required to operate the mixture control lever separately from the power lever and to adjust injection quantity. That is, the pilot is required to operate both the power lever and the mixture control lever.

Besides, as in the prior art, the degree of leaning has not been set in consideration of the engine temperature though the optimum degree of leaning in a lean burn control depends upon engine temperature. Thus, there is a technical problem in warming up wherein the air-fuel ratio is shifted too much on the lean side.

Further, as the ignition timing of the engine is also set based upon only engine speed in the vicinity of the lean limit or in a range beyond it in the prior art, it is difficult to ignite the engine at optimum timing when the air-fuel ratio is shifted on the lean side by lean burn control.

SUMMARY AND OBJECTS OF THE INVENTION

The first object of the invention is to solve the problems of the prior art and to provide a control system that enables an optimum lean burn control only by operating one lever beyond a lean limit of a lean burn engine.

The second object of the invention is to solve the problems of the prior art and to provide a control system that enables optimum lean burn control according to the engine temperature of a lean burn engine.

The third object of the invention is to solve the problems of the prior art and to provide a control system that enables the ignition timing of an engine to be set to optimum timing in lean burn control of a lean burn engine.

To achieve the objects, the invention is characterized in that the control system of the lean burn engine is provided with the following means.

The control system of the lean burn engine according to the present invention is provided with a throttle valve that controls the intake air quantity of the engine, a power lever that turns the throttle valve, means for detecting the manipulated variable of the power lever, means for determining the degree of leaning of an air-fuel mixture according to the detected manipulated variable and means for controlling the air-fuel ratio of the mixture so that the mixture becomes lean according to the determined degree of the leaning. A range in which the power lever is operated is secured up to a range beyond the full throttle position of the throttle valve, in the operational range beyond the full throttle position with the throttle valve being kept in a full throttle state and only the detected manipulated variable varies.

(2) The control system of the lean burn engine according to the present invention is characterized in that it is further provided with means for determining whether the engine is warmed up or not and means for controlling the degree of the leaning based upon the result of the determination.

(3) The control system of the lean burn engine according to the present invention is characterized in that it is provided with means for acquiring reference ignition timing based upon engine speed, means for acquiring a first correction amount related to ignition timing based upon the load of the engine, means for acquiring a second correction amount related to ignition timing based upon an air-fuel ratio according to the degree of the leaning, means for correcting the reference ignition timing by the first and second correction amounts and means for controlling the ignition of the engine at the corrected ignition timing.

According to the characteristic (1) described above, as the manipulated variable of the power lever is also quantitatively acquired in a range beyond the full throttle position of the throttle valve, the air-fuel ratio beyond the lean limit can be controlled by only the manipulated variable of the power lever.

According to the characteristic (2) described above, as the degree of leaning an air-fuel mixture is controlled according to whether the engine is warmed up or not, optimum lean burn control according to engine temperature is enabled.

According to the characteristic (3) described above, as the ignition timing of the engine can be set utilizing not only engine speed but a parameter in addition to engine speed, a more suitable lean burn control is enabled.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
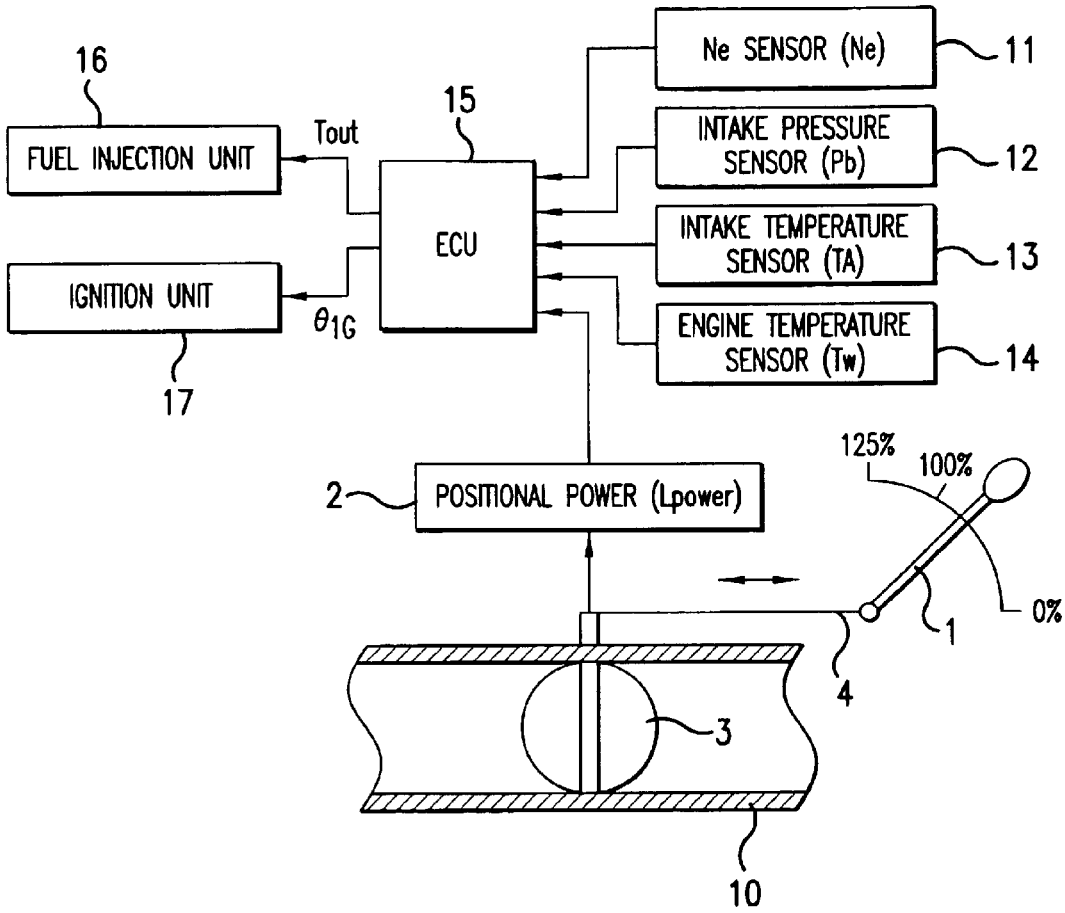
FIG. 1 is a block diagram showing a main part of an engine control system equivalent to one embodiment of the present invention.

Referring to the drawings, a preferred embodiment of the present invention will be described in detail below. FIG. 1 is a block diagram showing a main part of an engine control system equivalent to one embodiment of the invention and shows only the configuration required to understand the present invention.

A throttle valve 3 provided to a throttle body 10 is coupled to a power lever 1 via a link mechanism 4 and is turned in response to the operation of the power lever 1. The manipulated variable (L power)(%) of the power lever 1 is detected by a positional sensor 2. An Ne sensor 11 detects the engine speed Ne. An intake pressure sensor 12 detects the pressure Pb of air in an intake pipe. An intake temperature sensor 13 detects the temperature Tw of the air in the intake pipe. An engine temperature sensor 14 detects engine temperature TE based upon the temperature of cooling water. ECU 15 calculates time Tout when an injector is opened and the ignition timing θIG of an engine based upon a process value detected by each sensor described above and controls a fuel injection unit 16 and an ignition unit 17.

Figure 2:
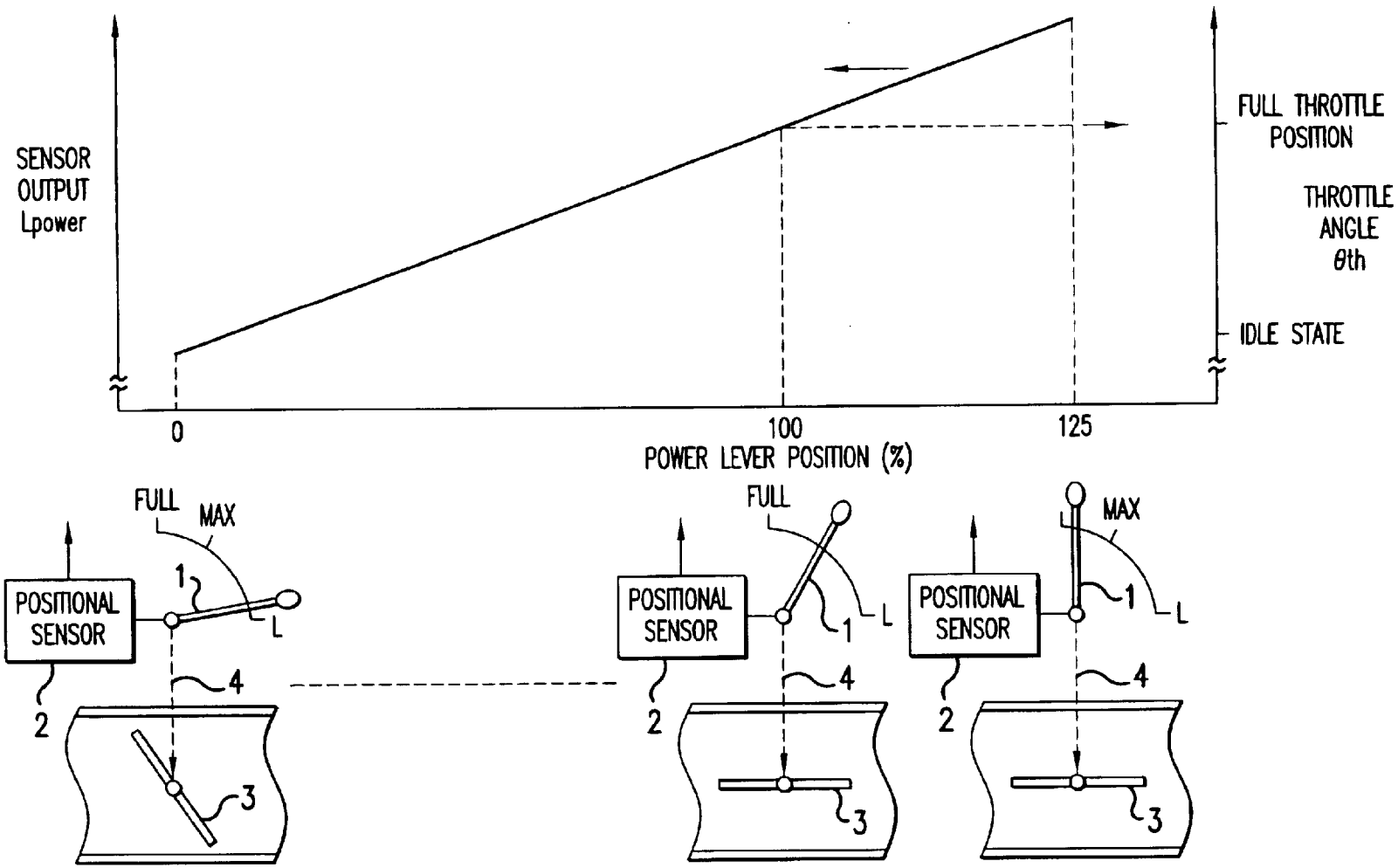
FIG. 2 schematically represents relation among the manipulated variable of a power lever, the output of a positional sensor and a throttle angle.

FIG. 2 schematically represents the relation among the position (the manipulated variable) of the power lever 1, the output Lpower of the positional sensor 2 and a throttle angle θth, and the same reference number as that described above denotes the same or similar part.

The link mechanism 4 opens the throttle valve 3 at an angle according to the manipulated variable of the power lever 1 while the throttle valve 3 is located in a range from an idle state L to a full throttle position MAX. When the power lever 1 is further operated beyond the full throttle position MAX of the throttle valve 3, the throttle valve 3 is maintained in the full throttle position independent of the position of the power lever 1 and only the positional sensor 2 outputs a signal according to the manipulated variable of the power lever 1.

As described above, this embodiment is characterized in that when the power lever 1 is operated beyond the full throttle position MAX of the throttle valve 3, the position is detected by the positional sensor 2 and the output of the engine is controlled according to the manipulated variable of the power lever 1 independent of the angle of the throttle valve 3 in a range of the operation beyond the full throttle position of the throttle valve 3.

Figure 3C:
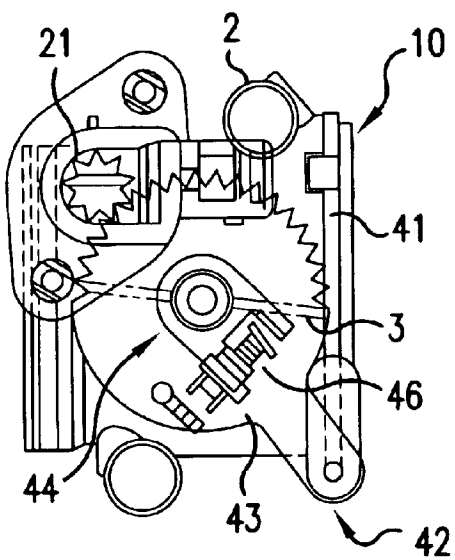
FIGS. 3(*a*) to 3(*c*) are side views partially removed showing the configuration of a main part of a throttle body provided with the positional sensor and a link mechanism.
Figure 3B:
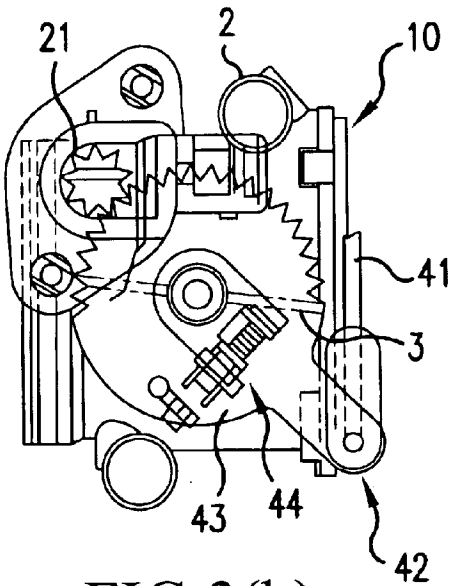
Figure 3A:
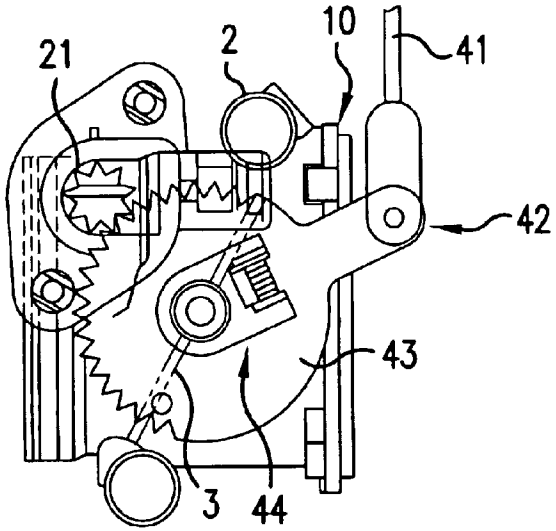
Figure 4:
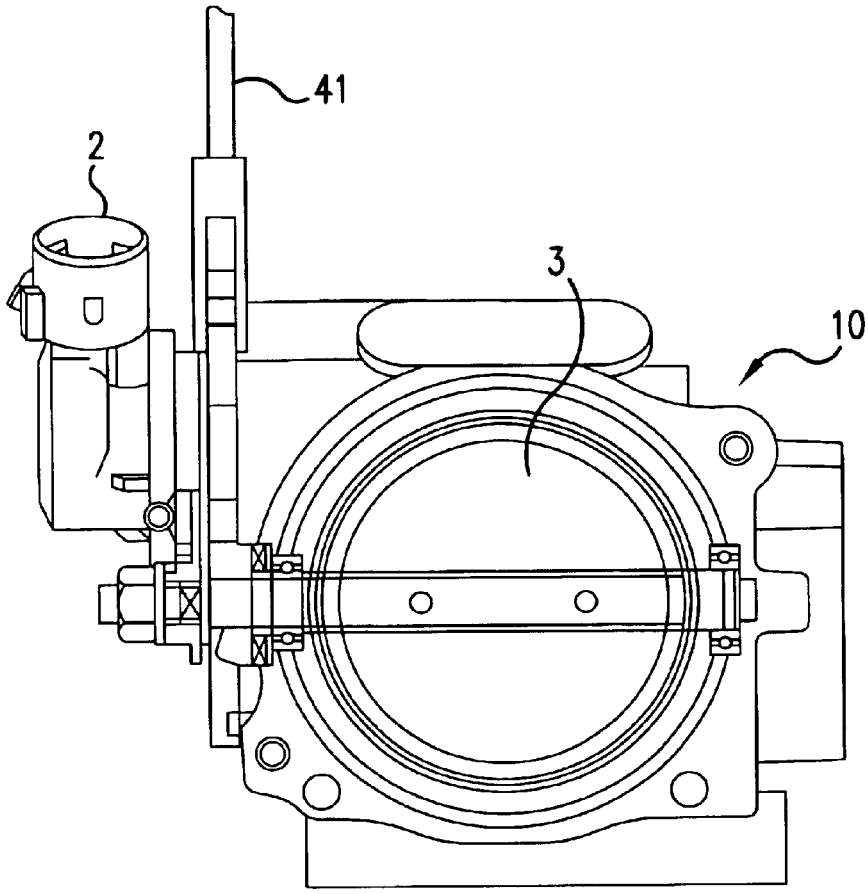
FIG. 4 shows the throttle body viewed from the direction of an intake passage.

FIGS. 3(*a*) to 3(*c*) are side views partially removed so that the following configuration is apparent showing the configuration of a main part of the throttle body 10 provided with the positional sensor 2 and the link mechanism 4. FIG. 3(*a*) shows an idle state, FIG. 3(*b*) shows a full throttle state and FIG. 3(*c*) shows a state in which the power lever 1 is further operated beyond the full throttle state. FIG. 4 shows the throttle body 10 viewed from a direction of an intake passage.

As shown in FIGS. 3(*a*) to 3(*c*) one end of push-pull wire 41 is coupled to the power lever 1 (not shown) and the other end is coupled to a throttle gear 43 via a crank mechanism 42. The throttle valve 3 is coaxially coupled to the throttle gear 43 via a lost motion mechanism 44. The positional sensor 2 is provided with a driven gear 21 engaged with the throttle gear 43 and detects the quantity of the displacement of the push-pull wire 41, that is, the manipulated variable of the power lever 1 by detecting the turning angle of the driven gear 21.

In such a configuration, when the power lever 1 in the idle state shown in FIG. 3(*a*) is operated and the push-pull wire 41 is pushed, the throttle gear 43 is turned according to the quantity of the displacement of the push-pull wire 41 to the full throttle position shown in FIG. 3(*b*) of the throttle valve 3 and further, the driven gear 21 is turned. The positional sensor 2 detects the turning angle of the driven gear 21 and outputs this as a signal showing the manipulated variable of the power lever 1.

When the push-pull wire 41 is further pushed beyond the full throttle position shown in FIG. 3(*b*), the throttle valve 3 is prevented from being further turned and remains maintained in the full throttle state. However, the throttle gear 43 is further turned to a predetermined limit position against the resilience of a coil spring 46 of the lost motion mechanism 44. At this time, as the driven gear 21 is also turned together with the throttle gear 43, the positional sensor 2 can also output a signal showing the manipulated variable of the power lever 1 after the power lever passes the full throttle position of the throttle valve 3.

Figure 5:
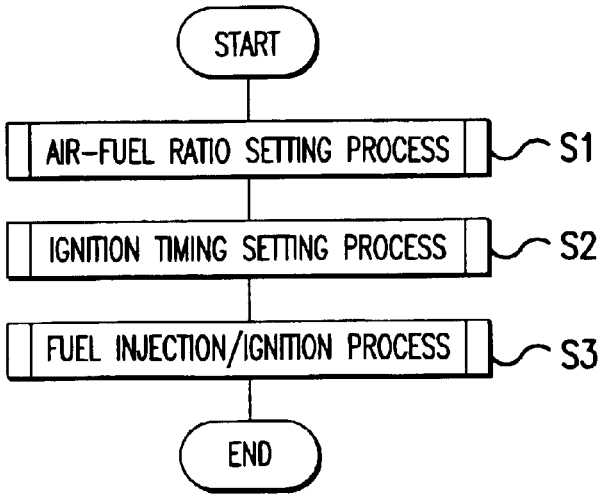
FIG. 5 shows a main flow for engine control.

Next, referring to a flowchart, engine control in this embodiment will be described in detail. FIG. 5 shows a main flow of engine control and it is periodically executed by ECU 15.

Figure 6:
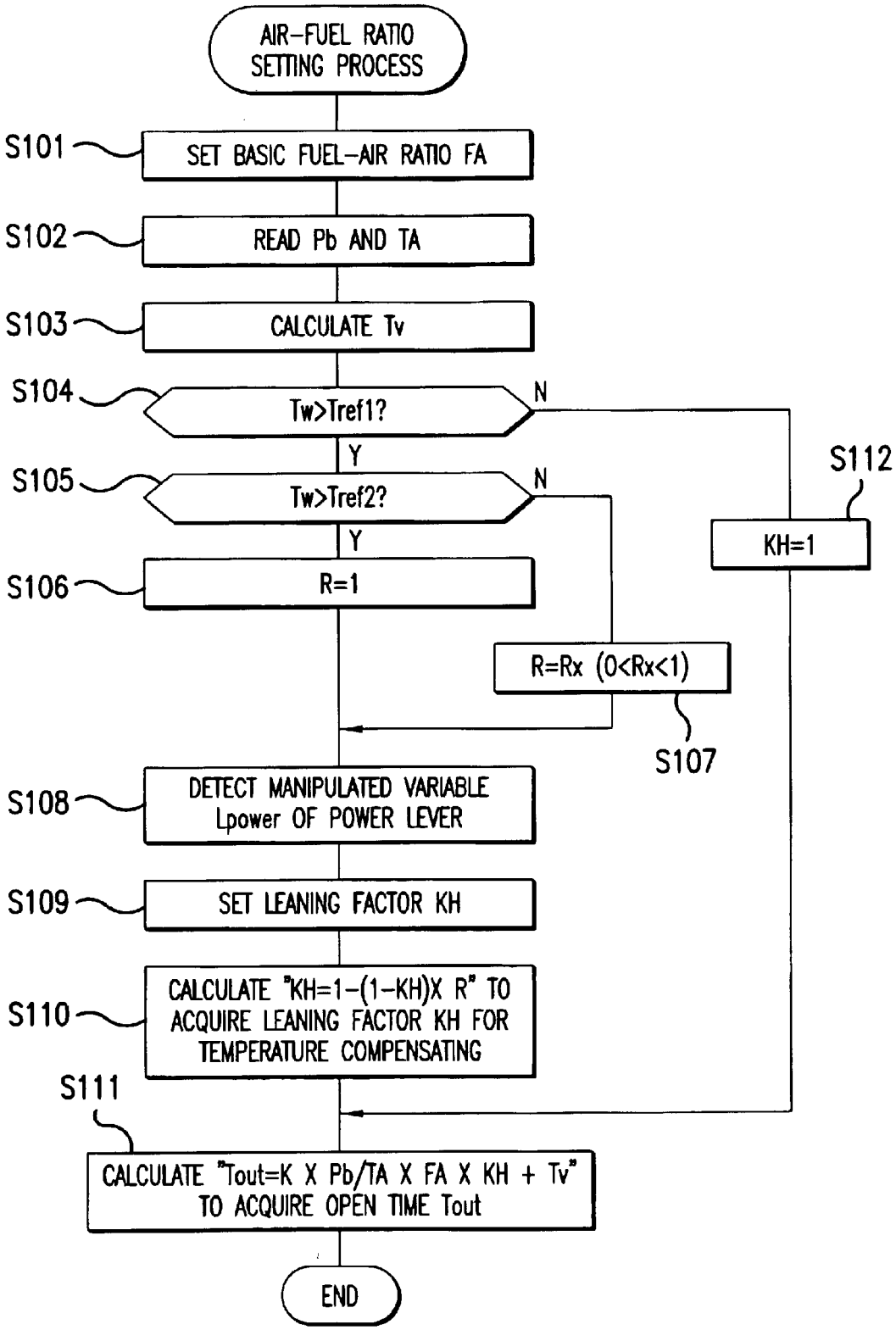
FIG. 6 is a flowchart showing a procedure of an air-fuel ratio setting process.

In a step S1, an air-fuel ratio setting process is executed. In this embodiment, the air-fuel (A/F) ratio is controlled by increasing or decreasing time Tout when the injector is opened. FIG. 6 is a flowchart showing a procedure of the air-fuel ratio setting process.

In step S101, the basic fuel-air (F/A) ratio is set. In this embodiment, the basic fuel-air ratio is set to 12.5 converted to air-fuel (A/F) ratio. In step S102, the intake pressure Pb detected by the intake pressure sensor 12 and intake temperature TA detected by the intake temperature sensor 13 are read. In step S103, a battery voltage compensating constant Tv for increasing or decreasing time when the injector is opened according to the variation of battery voltage is calculated.

In step S104, the temperature Tw of cooling water detected by the engine temperature sensor 14 is compared with first reference temperature Tref1. The first reference temperature Tref1 is a reference value for determining whether the engine is cool or not and in case the temperature Tw of cooling water exceeds the first reference temperature Tref1, the process proceeds to a step S105. In the step S105, the detected temperature Tw of cooling water is compared with a second reference temperature Tref2. The second reference temperature Tref2 is a reference value for determining whether the engine is completely warm or not and in case the temperature Tw of cooling water exceeds the second reference temperature Tref2, the process proceeds to a step S106 and in a case except it, the process proceeds to a step S107. In the step S106, 1 is set for a temperature compensating factor R. In the step S107, a predetermined value Rx ($0<Rx<1$) is set for the temperature compensating factor R.

Figure 8:
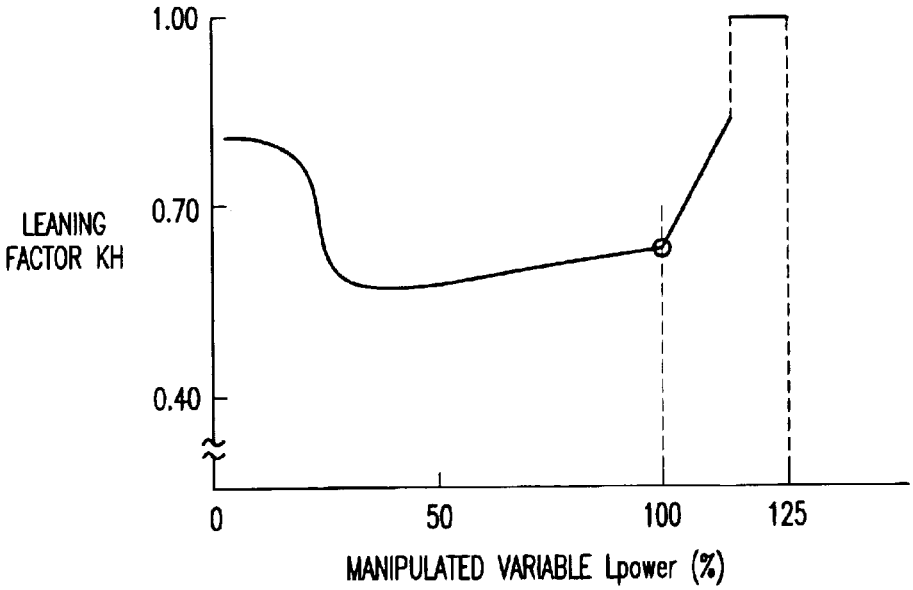
FIG. 8 shows the relation between the manipulated variable Lpower of the power lever 1 and a leaning factor KH.

In a step S108, the manipulated variable Lpower of the power lever 1 is acquired based upon a signal output from the positional sensor 2. In a step S109, a leaning factor KH is acquired based upon the manipulated variable Lpower of the power lever 1. In this embodiment, a data table that defines the relationship shown in FIG. 8 between the manipulated variable Lpower of the power lever 1 and the leaning factor KH is prepared beforehand and the leaning factor KH is acquired by retrieving the data table based upon the detected manipulated variable Lower. In a step S110, the leaning factor KH for temperature compensating is acquired as shown in the following expression (1).

$$KH=1-(1-KH)\times R \quad (1)$$

In case it is determined in the step S104 that the temperature Tw of cooling water is lower than the first reference temperature Tref1, the leaning factor KH is set to 1 in a step S112 independent of the manipulated variable Lpower of the power lever 1. In a step S111, time Tout when the injector is opened is acquired based upon the following expression (2). A factor K in this expression is a constant determined by the injection performance of the injector and others.

$$Tout=K\times Pb/TA\times FA\times KH+Tv \quad (2)$$

Figure 7:
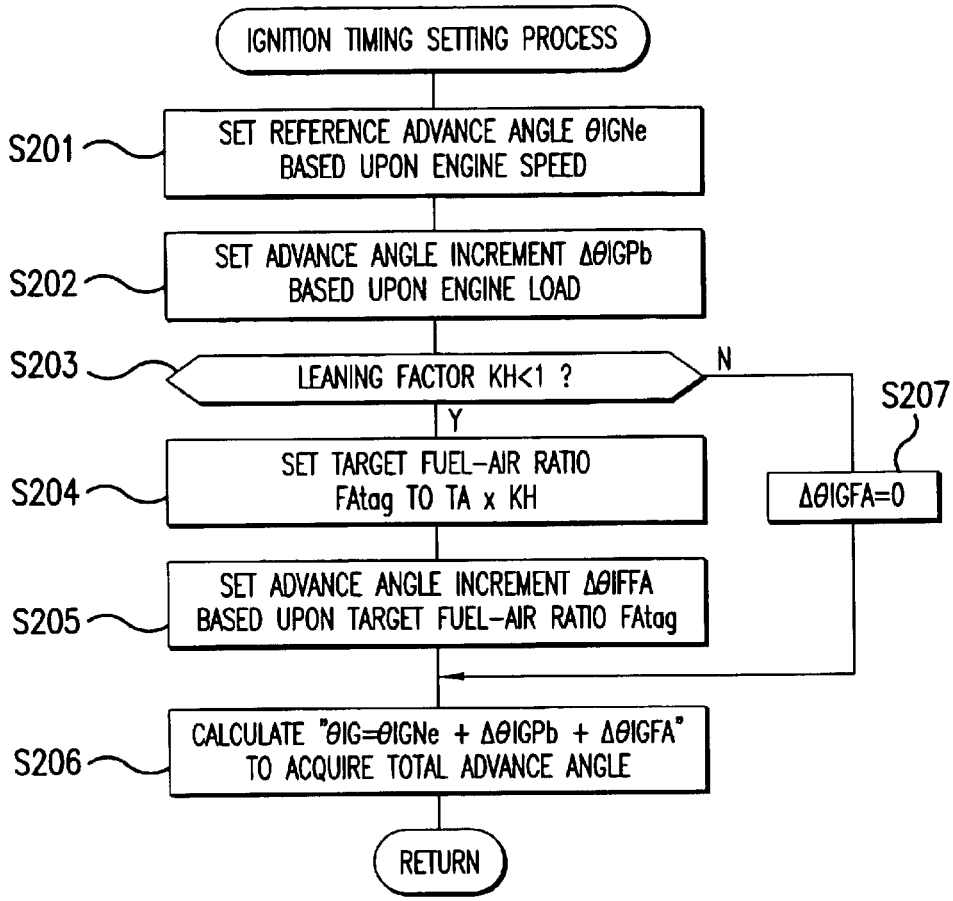
FIG. 7 is a flowchart showing a procedure of an ignition timing setting process.

When the time Tout when the injector is opened is acquired as described above, an ignition timing setting process is executed in a step S2 shown in FIG. 5. FIG. 7 is a flowchart showing a procedure of the ignition timing setting process.

Figure 9:
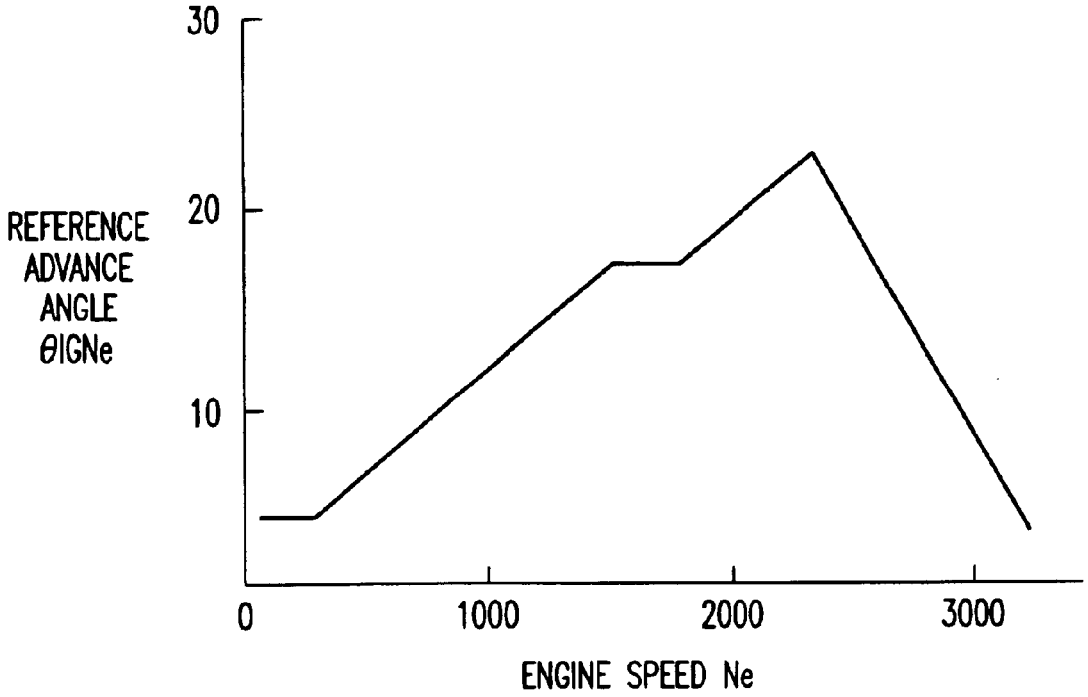
FIG. 9 shows the relation between engine speed Ne and a reference advance angle θIGNe.

In a step S201, a reference advance angle θIGNe is acquired based upon engine speed Ne. In this embodiment, a data table that defines the relationship shown in FIG. 9 between engine speed (Ne) and the reference advance angle (θIGNe) is prepared beforehand and the reference advance angle θIGNe is acquired by retrieving the data table based upon engine speed Ne.

Figure 10:
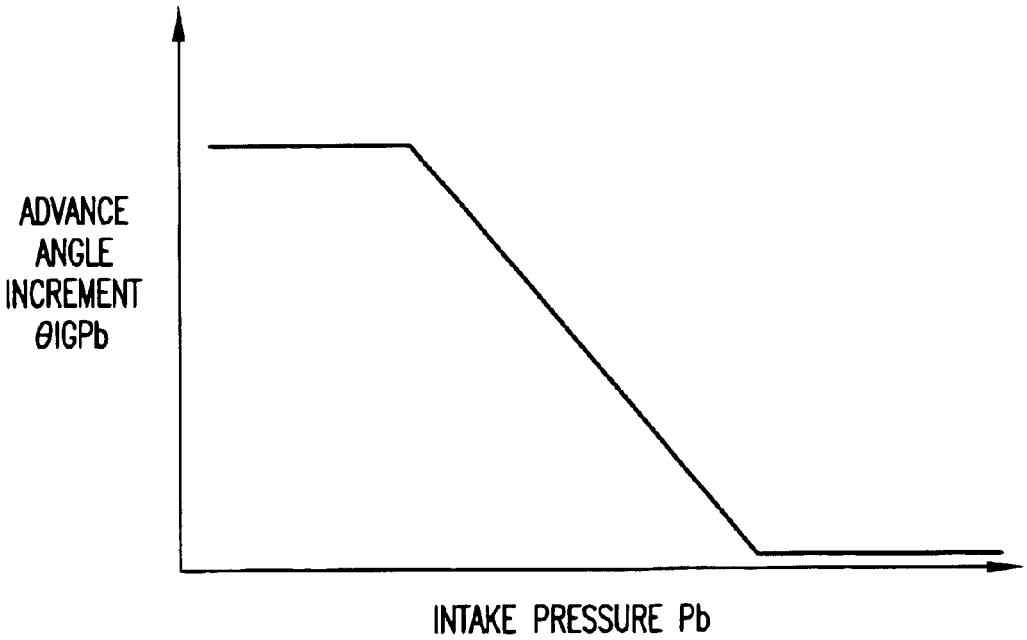
FIG. 10 shows the relation between intake pressure Pb and an advance angle increment ΔθIGPb.

In a step S202, an advance angle increment ΔθIGPb according to a load of the engine is acquired. In this embodiment, a data table that defines the relationship shown in FIG. 10 between intake pressure Pb representing the load of the engine and the advance angle increment ΔθIGPb is prepared beforehand and the advance angle increment ΔθIGPb is acquired by retrieving the data table based upon intake pressure Pb.

In a step S203, it is determined whether the leaning factor KH acquired in the step S110 is smaller than 1 or not and if the factor is smaller than 1, the process proceeds to a step S204. In the step S204, a target fuel-air (F/A) ratio tag is acquired as the product of the basic fuel-air (F/A) ratio and the leaning factor KH in the following expression (3).

$$FAtag=FA\times KH \quad (3)$$

Figure 11:
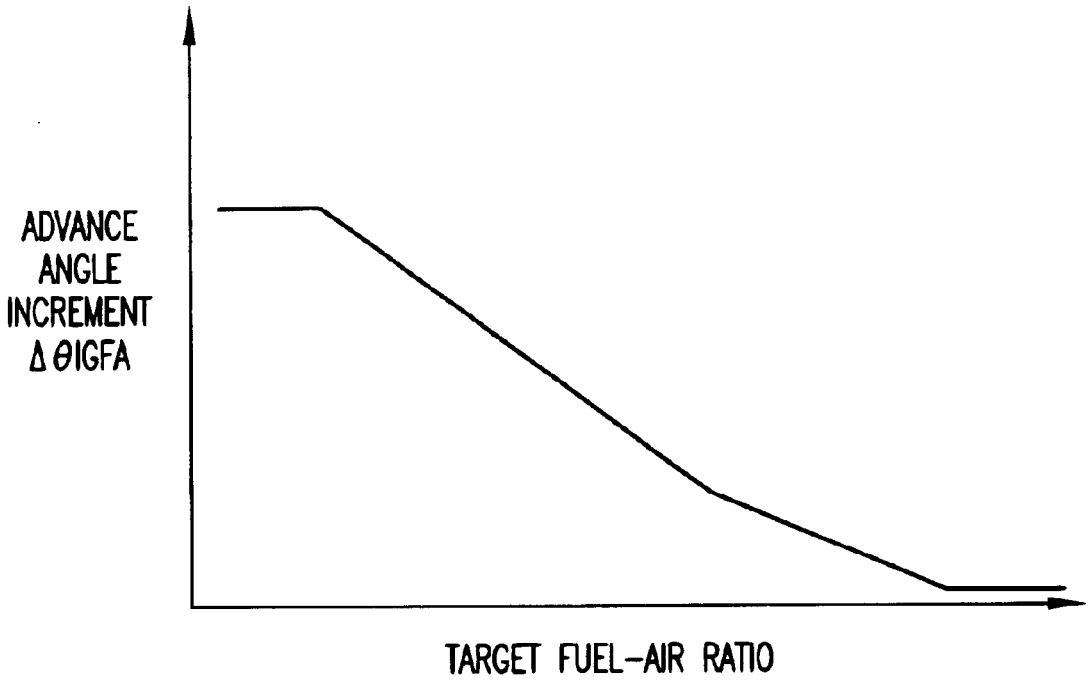
FIG. 11 shows the relation between a target fuel-air (F/A) ratio tag and an advance angle increment ΔθIGFA.

In a step S205, an advance angle increment ΔθIGFA is acquired based upon the target fuel-air (F/A) ratio tag. In this embodiment, a data table that defines the relationship shown in FIG. 11 between the target fuel-air (F/A) ratio tag and the advance angle increment ΔθIGFA is prepared beforehand and the advance angle increment ΔθIGFA is acquired by retrieving the data table based upon the target fuel-air (F/A) ratio tag.

Unless the leaning factor KH is smaller than 1 in the step S203, the advance angle increment ΔθIGFA is set to 0 in a step S207. In a step S206, a total advance angle θIG is acquired as the total of the reference advance angle θIGNe, the advance angle increment ΔθIGPb according to the load of the engine and the advance angle increment ΔθIGFA according to the target fuel-air (F/A) ratio tag.

When the total advance angle θIG is acquired as described above, the fuel injection unit 16 is controlled based upon time Tout when the injector is opened in a step S3 in FIG. 5 and the ignition unit 17 is controlled based upon the total advance angle θIG.

Figure 12:
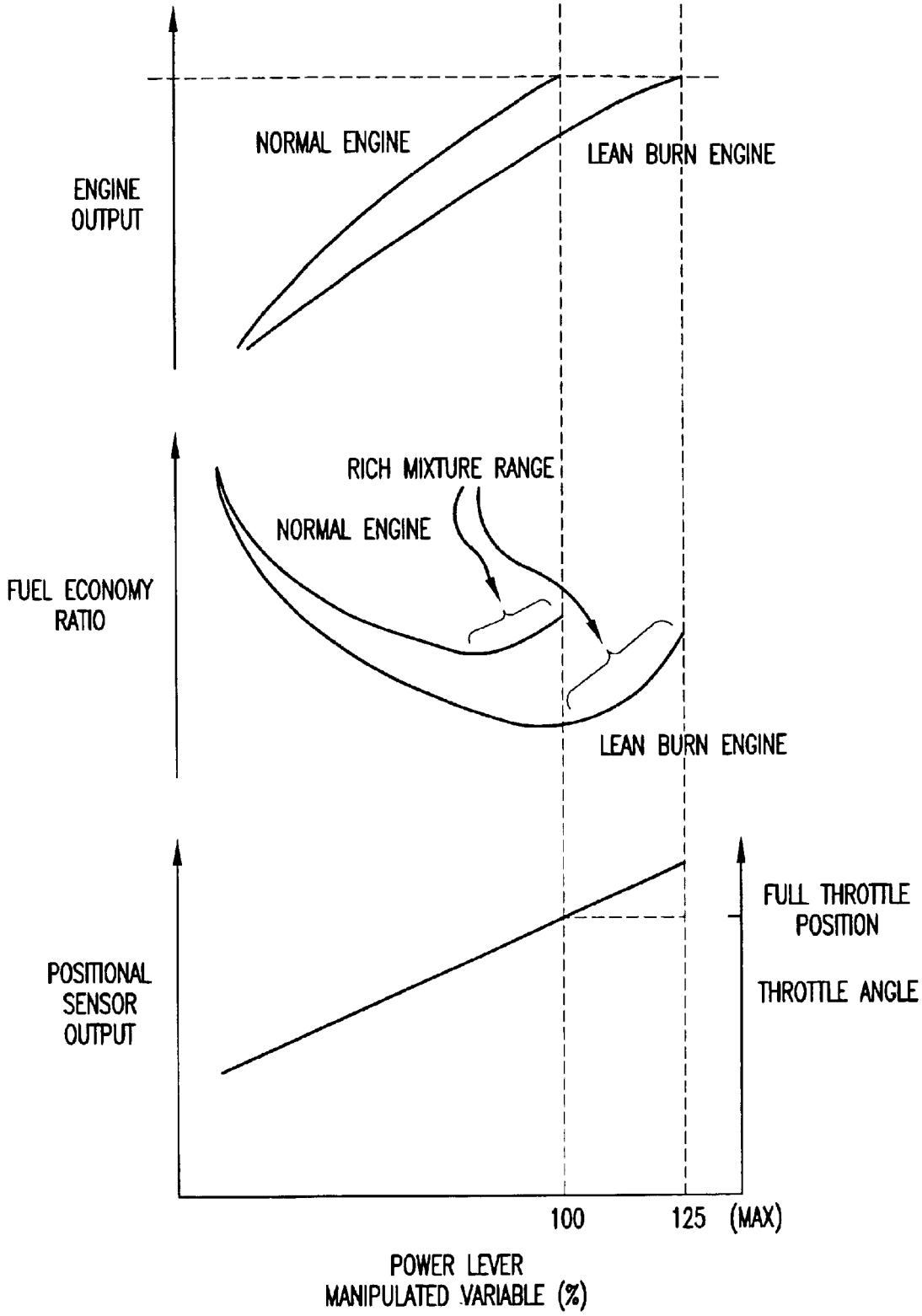
FIG. 12 compares the output characteristic and the fuel economy ratio characteristic of a lean burn engine to which the invention is applied with those of a conventional type normal engine.
Figure 13:
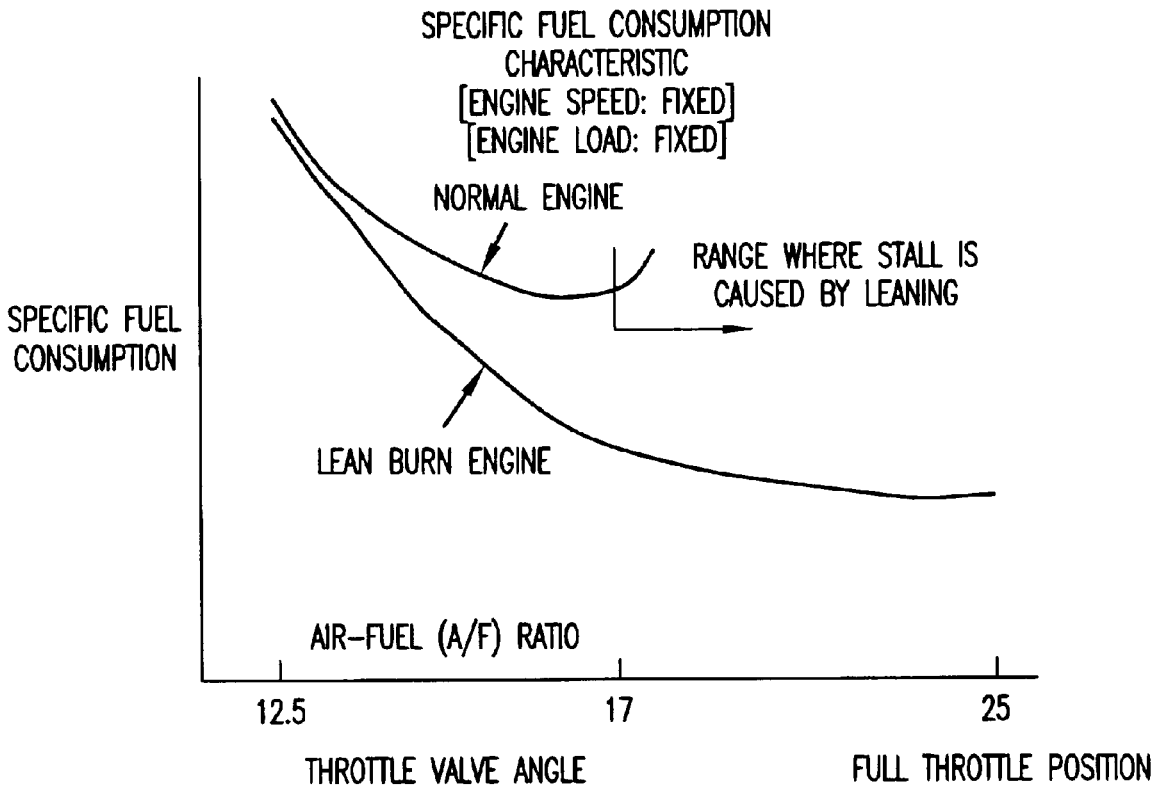
FIG. 13 shows the relation of air-fuel ratio (and a throttle angle) and a specific fuel consumption between the lean burn engine and the normal engine except it.

FIG. 12 compares the output characteristic and the fuel economy ratio characteristic of a lean burn engine to which the invention is applied with those of a conventional type normal engine.

In this embodiment, as an air-fuel mixture can be also densified according to the manipulated variable of the power lever 1 detected by the positional sensor 2 after the throttle valve is fully opened, the output of the engine can be kept large in a wide range by only the operation of the power lever 1. Besides, in this embodiment, as the air-fuel ratio is controlled according to engine temperature and ignition timing is dynamically controlled according to the load of the engine and the degree of leaning the air-fuel mixture, further fuel economy is enabled.

According to the present invention, the following effect is achieved.

According to the present invention, as the manipulated variable of the power lever is also quantitatively acquired in a range beyond the full throttle position of the throttle valve, the air-fuel ratio beyond a lean limit can be controlled based upon only the manipulated variable of the power lever.

According to the present invention, as the degree of leaning an air-fuel mixture is decreased and the air-fuel ratio is shifted on the rich side when the power lever is operated beyond the lean limit, the output of the engine can be enhanced.

According to the present invention, as the degree of leaning an air-fuel mixture is controlled according to whether the engine is warmed up or not, optimum lean burn control according to engine temperature is enabled.

According to the present invention, as the ignition timing of the engine can be set utilizing not only engine speed but a parameter except the engine speed, more suitable lean burn control is enabled.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lean burn engine control system, comprising:

a throttle valve for controling the intake air quantity of an engine;

a power lever for turning the throttle valve;

means for detecting the manipulated variable of the power lever;

means for determining the degree of leaning of an air-fuel mixture according to the detected manipulated variable; and means for controlling the air-fuel ratio of the mixture so that the mixture becomes lean according to the determined degree of the leaning, wherein:

a range in which the power lever is operated is secured up to a range beyond the full throttle position of the throttle valve;

in the operational range beyond the full throttle position, the throttle valve is kept at a full throttle state; and only the detected manipulated variable varies.

2. The lean burn engine control system according to claim 1, wherein:

in the operational range beyond the full throttle position, the degree of the leaning is decreased according to the manipulated variable.

3. The lean burn engine control system according to claim 2, further comprising:

means for determining whether the engine is warmed up or not; and means for controlling the degree of the leaning based upon the result of the determination.

4. The lean burn engine control system according to claim 2, comprising:

means for acquiring reference ignition timing based upon engine speed;

means for acquiring a first correction amount related to ignition timing based upon the load of an engine;

means for acquiring a second correction amount related to ignition timing based upon an air-fuel ratio according to the degree of the leaning;

means for correcting the reference ignition timing by the first and second correction amounts; and means for controlling the ignition of the engine at the corrected ignition timing.

5. The lean burn engine control system according to claim 1, further comprising:

means for determining whether the engine is warmed up or not; and means for controlling the degree of the leaning based upon the result of the determination.

6. The lean burn engine control system according to claim 5, comprising:

means for acquiring reference ignition timing based upon engine speed;

means for acquiring a first correction amount related to ignition timing based upon the load of an engine;

means for acquiring a second correction amount related to ignition timing based upon an air-fuel ratio according to the degree of the leaning;

means for correcting the reference ignition timing by the first and second correction amounts; and means for controlling the ignition of the engine at the corrected ignition timing.

7. The lean burn engine control system according to claim 1, comprising:

means for acquiring reference ignition timing based upon engine speed;

means for acquiring a first correction amount related to ignition timing based upon the load of an engine;

means for acquiring a second correction amount related to ignition timing based upon an air-fuel ratio according to the degree of the leaning;

means for correcting the reference ignition timing by the first and second correction amounts; and means for controlling the ignition of the engine at the corrected ignition timing.

8. The lean burn engine control system according to claim 1, and further including a push-pull member operatively connected to the power lever for imparting movement to the power lever for adjusting the throttle valve.

9. The lean burn engine control system according to claim 8, wherein the means for detecting the manipulated variable of the power lever is a positional sensor including a driven gear operatively connected to a throttle gear for detecting the manipulated variable of the power lever by detecting a turning angle of the driven gear.

10. The lean burn engine control system according to claim 9, and further including a lost motion mechanism operatively connected to the throttle gear for compensating for movement of the push-pull member beyond a full throttle position.

11. A lean burn engine control system, comprising:

a throttle valve for controlling the intake air quantity of an engine;

a power lever operatively connected to the throttle valve for turning the throttle valve;

detecting means for detecting the manipulated variable of the power lever;

determining means for determining the degree of leaning of an air-fuel mixture according to the detected manipulated variable; and control means for controlling the air-fuel ratio of the mixture so that the mixture becomes lean according to the determined degree of the leaning;

wherein a range in which the power lever is operated is secured up to a range beyond the full throttle position of the throttle valve and in the operational range, beyond the full throttle position, the throttle valve is kept at a full throttle state and only the detected manipulated variable varies.

12. The lean burn engine control system according to claim 11, wherein:

in the operational range beyond the full throttle position, the degree of the leaning is decreased according to the manipulated variable.

13. The lean burn engine control system according to claim 12, further comprising:

means for determining a temperature of an engine; and means for controlling the degree of the leaning based upon the temperature of an engine.

14. The lean burn engine control system according to claim 12, comprising:

means for acquiring reference ignition timing based upon engine speed;

means for acquiring a first correction amount related to ignition timing based upon the load of an engine;

means for acquiring a second correction amount related to ignition timing based upon an air-fuel ratio according to the degree of the leaning;

means for correcting the reference ignition timing by the first and second correction amounts; and means for controlling the ignition of the engine at the corrected ignition timing.

15. The lean burn engine control system according to claim 11, further comprising:

means for determining a temperature of an engine; and means for controlling the degree of the leaning based upon the temperature of an engine.

16. The lean burn engine control system according to claim 15, comprising:

means for acquiring reference ignition timing based upon engine speed;

means for acquiring a first correction amount related to ignition timing based upon the load of an engine;

means for acquiring a second correction amount related to ignition timing based upon an air-fuel ratio according to the degree of the leaning;

means for correcting the reference ignition timing by the first and second correction amounts; and means for controlling the ignition of the engine at the corrected ignition timing.

17. The lean burn engine control system according to claim 11, comprising:

means for acquiring reference ignition timing based upon engine speed;

means for acquiring a first correction amount related to ignition timing based upon the load of an engine;

means for acquiring a second correction amount related to ignition timing based upon an air-fuel ratio according to the degree of the leaning;

means for correcting the reference ignition timing by the first and second correction amounts; and means for controlling the ignition of the engine at the corrected ignition timing.

18. The lean burn engine control system according to claim 11, and further including a push-pull member operatively connected to the power lever for imparting movement to the power lever for adjusting the throttle valve.

19. The lean burn engine control system according to claim 18, wherein the means for detecting the manipulated variable of the power lever is a positional sensor including a driven gear operatively connected to a throttle gear for detecting the manipulated variable of the power lever by detecting a turning angle of the driven gear.

20. The lean burn engine control system according to claim 19, and further including a lost motion mechanism operatively connected to the throttle gear for compensating for movement of the push-pull member beyond a full throttle position.

* * * * *